US005941344A

United States Patent [19]

Spadaro

[11] Patent Number: 5,941,344

[45] Date of Patent: Aug. 24, 1999

[54] PORTABLE LADDER TOP-WORK STATION TOOL BOX COMBINATION

[76] Inventor: Jerry J. Spadaro, 44 Nottingham Way, Middletown, N.J. 07748

[21] Appl. No.: 09/080,155

[22] Filed: May 18, 1998

[51] Int. Cl.[6] ..... E06C 7/14

[52] U.S. Cl. ..... 182/129; 248/210

[58] Field of Search ..... 182/129; 248/210, 248/238

[56] References Cited

U.S. PATENT DOCUMENTS

| | | | |
|---|---|---|---|
| 4,356,854 | 11/1982 | McGee | 182/129 |
| 5,603,405 | 2/1997 | Smith | 182/129 |
| 5,613,574 | 3/1997 | Melanson | 182/129 |
| 5,740,883 | 4/1998 | Trank | 182/129 |
| 5,782,314 | 7/1998 | Zeifler | 182/129 |

*Primary Examiner*—Alvin Chin-Shue
*Attorney, Agent, or Firm*—Charles I. Brodsky

[57] ABSTRACT

A caddy tray having a top side for receiving individual ones of tools, parts and/or components in prescribed locations, also having an underside of defined configuration to fit over the top step of a step-ladder, with adjustable straps in a preferred embodiment to releasably secure the tray to the top step and to the ladder for use, and to detach from the ladder for later storage, in the organization of tools, parts and components for a worker while preventing them from falling from the ladder to the ground.

5 Claims, 4 Drawing Sheets

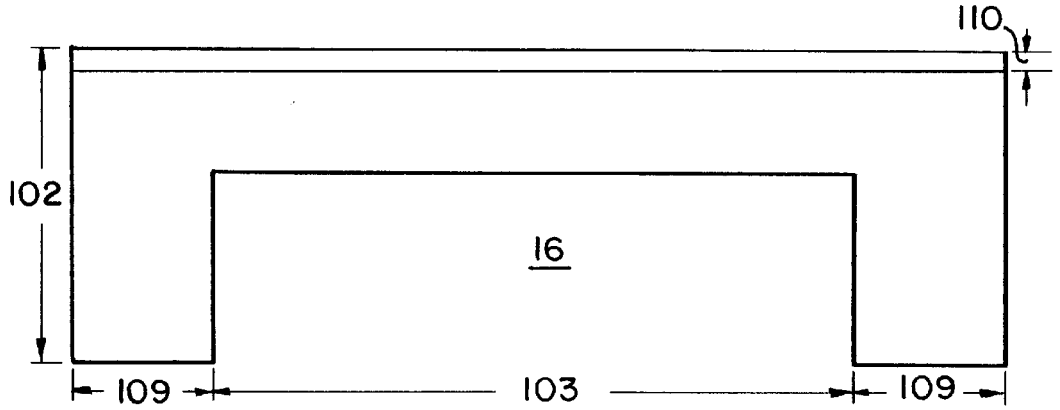
FIG. 2
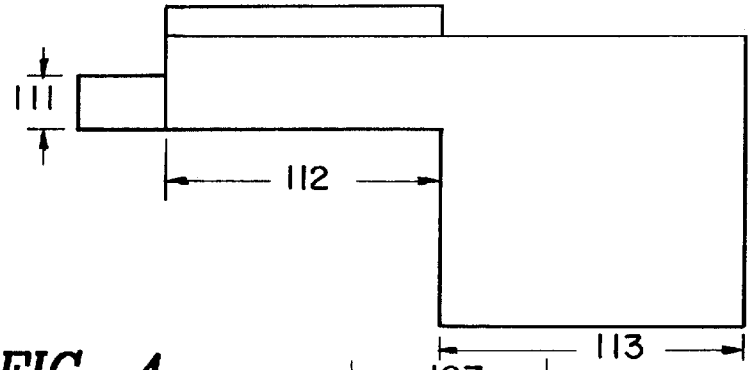
FIG. 3
FIG. 4
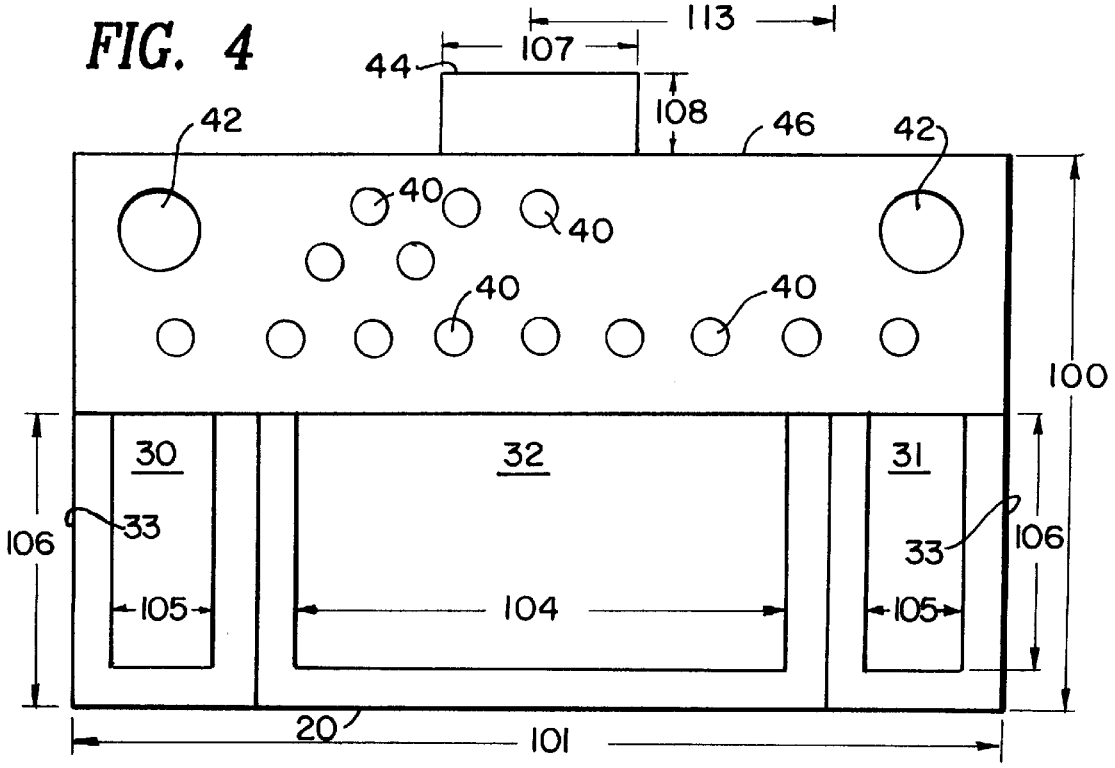

PORTABLE LADDER TOP-WORK STATION TOOL BOX COMBINATION

FIELD OF THE INVENTION

This invention relates to the step-ladder industry, in general, and to the use of step-ladders by those engaged in the building contracting field, in particular.

BACKGROUND OF THE INVENTION

As is well known and appreciated, such building contractors as electricians, plumbers and carpenters frequently utilize step-ladders in their daily endeavors. As is also known and appreciated, these and other contractors, oftentimes wear a belt around their waist having a series of pouches in which various ones of tools, parts and/or components are temporarily held until needed in the installations being made. While helpful, many of these professional contractors do not particularly like the belt because it is bulky, and it gets in the way. Also, even though the belt is beneficial in having a place to carry one's tools—thereby freeing the hands for working—many types of tools, parts and/or components cannot fit within the space provided—such as power drills, electrical ballast for fluorescent fixtures, soldering guns, etc. In circumstances where these types of devices are involved, the workman typically lays them down on the top step of the ladder after use, or places them on the first step to be later reached for and grabbed when needed. Experience has shown, however, that these tools, fixtures, etc. are not very stabile, and frequently fall from the ladder, being damaged upon striking the floor. The alternative for these workers in the construction trades—as well as for alarm installers and handymen of just about any type—of either repeatedly going up and down the ladder to get the appropriate tool, part or component as needed—or having it handed to them when required, as by an assistant—leaves much to be desired, as the process is both time consuming and wasteful in one respect, and unduly costly in the other respect of having a second worker present. In these instances where "time" translates into "costs" for the consumer, it will be apparent that a significant cost savings could result if these "down-times" or "added-workmen" expenses could be reduced, or eliminated entirely.

OBJECTS OF THE INVENTION

It is an object of the present invention, therefore, to provide a new and improved way of having tools, parts and/or components readily available to a construction trade worker utilizing a step-ladder in carrying out his or her activities at a job site.

It is an object of the present invention, also, to provide such a manner of accomplishing this, which is not at all uncomfortable to the worker carrying out the construction task—whether it be in the nature of electrical work, plumbing work, alarm installation, etc.

It is another object of the invention, to carry out these work-related tasks in a manner which eliminates the known occurrence of tools, parts, and/or components falling from a ladder, causing damage to the devices, or causing accidents to possibly follow.

It is a further object of the invention to allow the professional construction worker, or even the home handyman, to carry out the work intended, having, at any one time, many more tools and units available while on the step ladder than are possible with the simple wearing of a belt with a series of pouches for tools, for example, no mater how comfortable such a belt might happen to be.

SUMMARY OF THE INVENTION

As will become clear from the following description, the present invention comprises a portable ladder top-work station tool box combination in which a caddy tray is removably secured to the top step of the ladder. More specifically—and as will be described—the caddy tray includes a top side for receiving individual ones of these tools, parts and/or components in prescribed locations, and an underside of defined configuration to hold to the top step of the ladder when placed upon it. In accordance with the invention, means—preferably in the nature of removable straps—cooperate with the tray and with the top step to removably secure the tray to the top step and to the ladder when in use, with the straps, for example, then being able to detach the tray from the step-ladder for later storage.

In the embodiment of the invention to be described, the straps are adjustable, and extend from one of a front and rear surface of the caddy tray, under the top step of the ladder, and fasten to the other of the front and rear surface of the tray when in use. The caddy tray, being defined in this respect with an underside to provide a snug fit to the top step when it is placed thereon, is constructed to include a plurality of compartmentalized sections for receiving various ones of these tools, parts and/or components—with two sections preferably extending over the sides of the top step, of a depth able to receive and hold such tools as clamps, cutters and pliers, and such components as fluorescent fixture ballasts. In accordance with the invention, a further compartmentalized section is included, of a shallower depth, to store various parts as washers, bolts, nuts, measuring tape and the like—essentially as a holding compartment.

In a preferred embodiment of the invention, additionally, a plurality of apertures are provided proximate to a rear surface of the caddy tray, of an area opening less than the area opening of either of these afore-mentioned compartmentalized sections, for receiving screwdrivers of differing size, for example, for holding a hammer in place, for holding and supporting an electric power drill, a soldering gun, etc. A clamp surface, furthermore, may be utilized, according to the invention, adjacent to this rear surface, to hold a snake-type light which can then be directed upwardly or at any desired angle, to illuminate the locale where the worker's attention is directed, if desired. As will be appreciated, in all these arrangements, the straps of the invention can be fastened to fixedly secure the caddy tray to the top step of the ladder when in use, and can be unfastened to later remove it for storage when the job at hand is completed. In this respect, it will be understood that any type of fastening-unfastening arrangement for the straps can be utilized.

BRIEF DESCRIPTION OF THE DRAWINGS

These and other features of the present invention will be more clearly understood from a consideration of the following description, taken in connection with the accompanying drawings, in which:

FIGS. 2–4 are front, left-side and top views of the caddy tray of the invention, a right-side view of which would be a mirror image of the left-side view of FIG. 3.

DETAILED DESCRIPTION OF THE INVENTION

Figure 1:
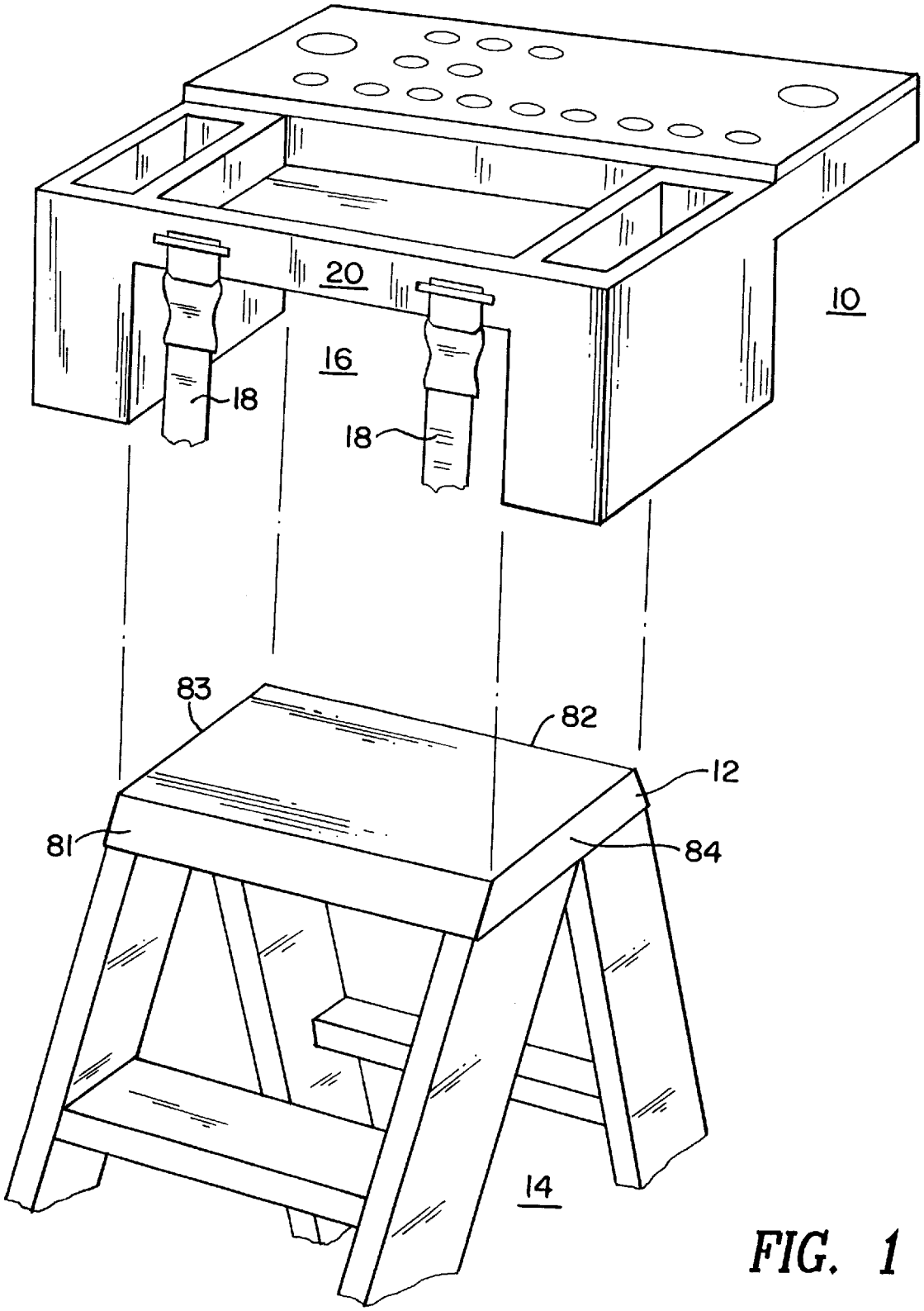
FIG. 1 pictorially illustrates (though not to scale), the caddy tray of the invention as it is readied to be secured about the top step of the step-ladder in establishing the work station, tool box combination.

In the drawings, reference numeral 10 identifies the caddy tray of the invention, for removable securement about the top step 12 of a step-ladder 14 of any standard design. Preferably constructed of a non-electrically conductive, durable, unbreakable, light-weight molded plastic, the caddy tray 10 incorporates a top side for receiving individual ones of tools, parts and/or components in prescribed locations, and an underside of defined configuration to hold to the top step 12 when placed upon it. Such underside, represented by the reference numeral 16, moreover, is configured to exhibit a snug fit when placed over the top step 12, in facilitating its detachable securement to the ladder 14, by means of a pair of straps 18 of extendible length fastenable between the front surface 20 of the caddy tray 10 and an opposite rear surface thereon (46) in any appropriate manner. As will be appreciated, in this way, not only is the step-ladder 14 stable on the floor, but the caddy tray-work station on the top step 12 is rigidly secured to it, as well.

As shown in FIGS. 1 and 4, the caddy tray 10, in this preferred embodiment, includes three compartmentalized sections 30, 31 and 32—the sections 30 and 31 being adjacent to the side surfaces 33 of the caddy tray 10, and the section 32 being adjacent to the front surface 20, between the two sections 30, 31. As more readily seen from FIG. 5, the sections 30, 31 are of a depth greater than that of the section 32, to accommodate such tools as wrenches, clamps and pliers, and such parts as fluorescent light ballasts—those in the section 30 being identified by the collective reference numeral 35, and those in the section 31 being indicated by the collective reference numeral 36. Also shown in FIG. 4 are a plurality of apertures 40 of various area opening to accept such tools as screwdrivers of differing size (75 in FIG. 5). Larger apertures 42 are also included (FIG. 4) to accommodate the holding of a hammer, for example (76 in FIG. 5) or a power drill, soldering gun, or other equipment (77 in FIG. 5). The compartmentalized section 32 of lesser depth, in accordance with the invention, is particularly useful in holding miscellaneous parts and components, as washers, bolts, nuts, tape, etc., as shown by the reference numeral 78 in FIG. 5. A further block 44 at the rear of the caddy tray 10 is included, to support a snake-type lamp, which may be clamped to the block 44 in any typical manner, the lamp being shown as 79 in FIG. 5.

Figure 5:
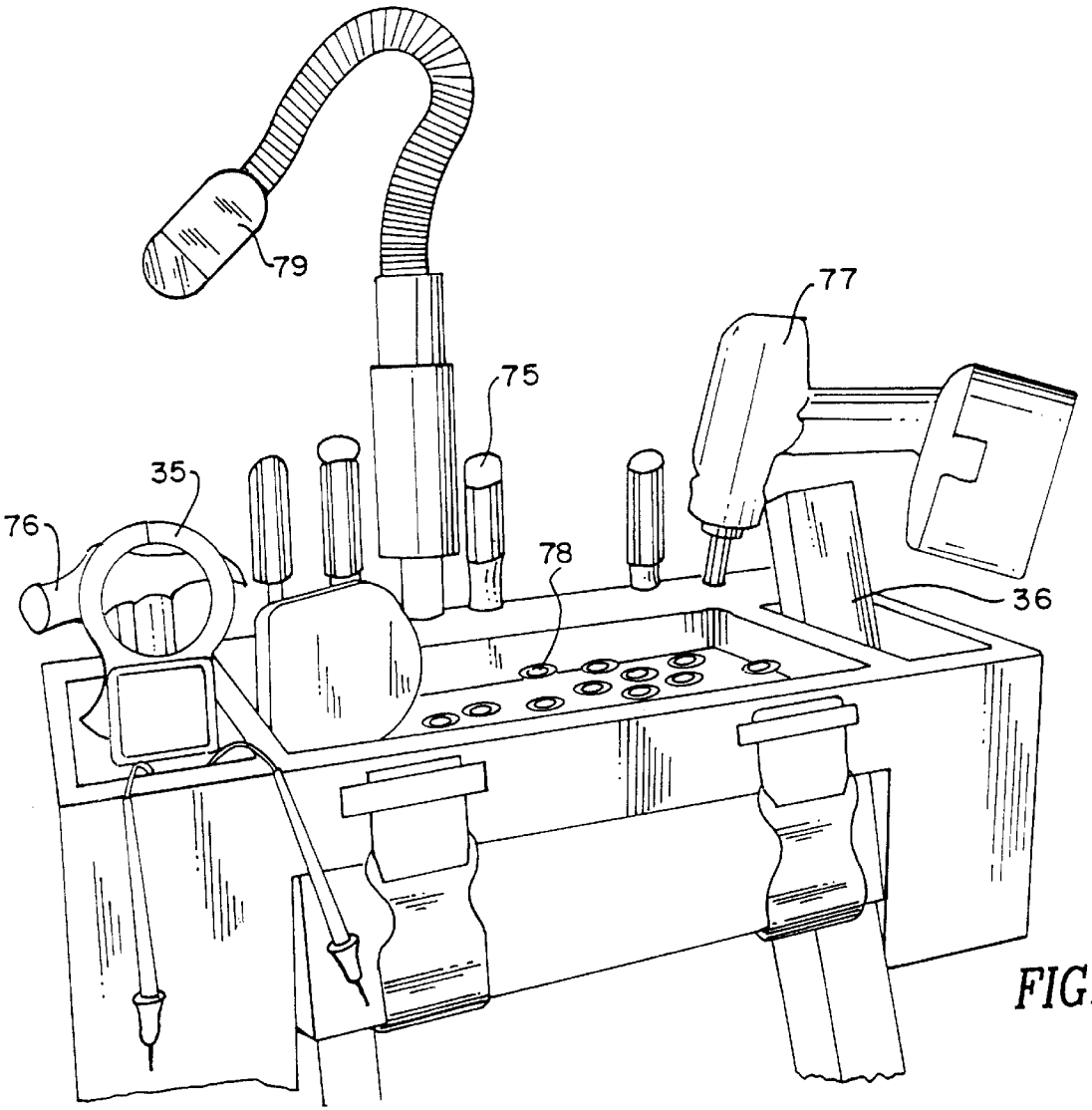
FIGS. 5–6 are helpful in an understanding of how the portable ladder top-work station tool box combination of the invention is beneficial to a worker in the building construction field.
Figure 6:
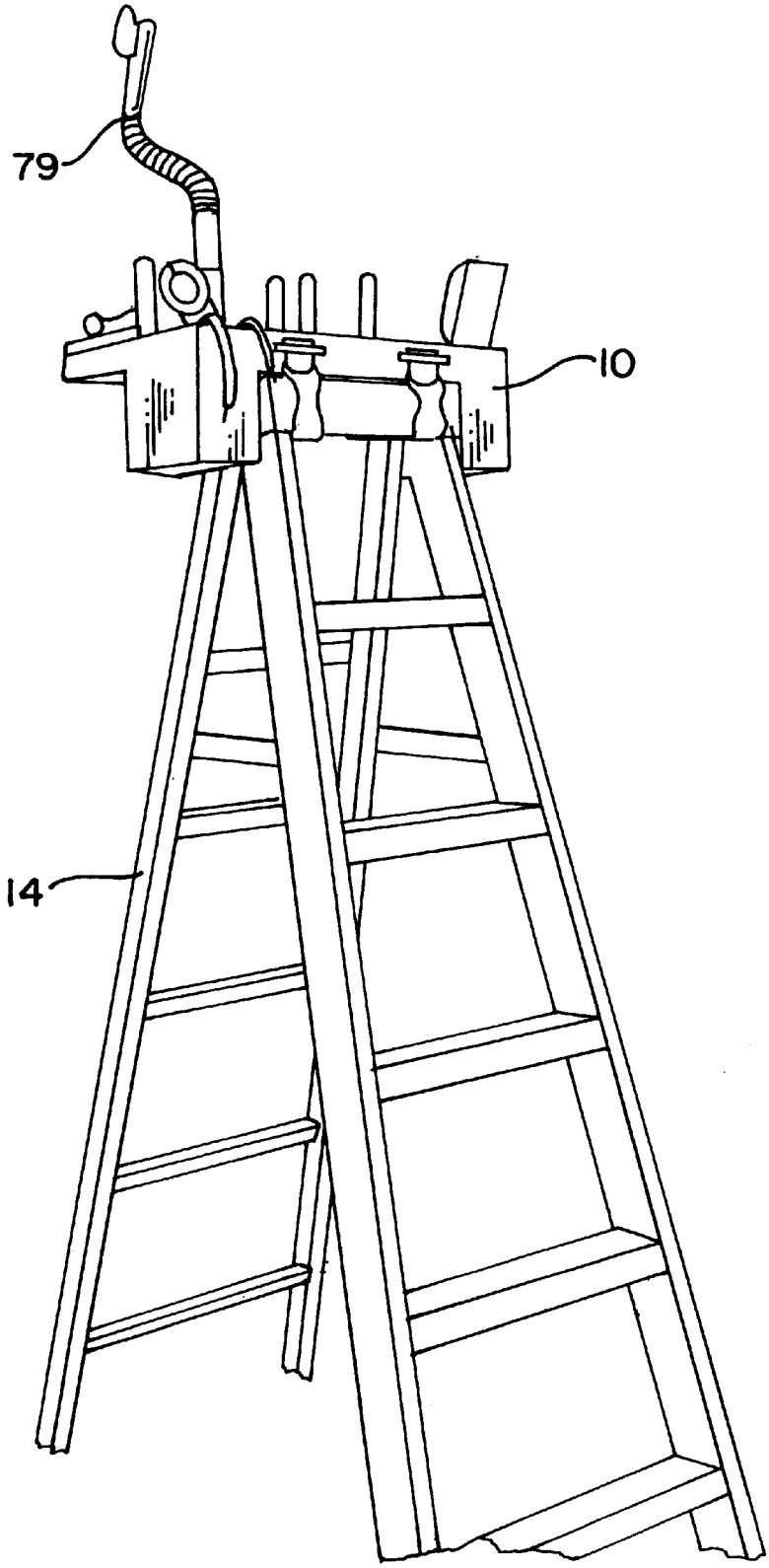

To provide sufficient holding area for the various tools, parts and/or components to be carried in the caddy tray 10, the tray 10 is designed of a width 100 to allow at least one of its front 20 and rear surfaces 46 to overlap the top step 12. In the arrangement of FIG. 5, for example, the straps 18 substantially hold the front surface 20 flush with the front 81 of the top step 12, while the rear surface 46 extends over the rear 82 of the top step 12. At the same time, the length 101 of the caddy tray 10 is selected to allow the compartments 30, 31 to overlap the side surfaces 83, 84 of the top step 12 to allow the storage of the wrenches, pliers, clamps, ballast, etc. inside. The height 102 of the tray 10 is selected to accommodate the parts held in the section 32 as well as to allow the various screwdrivers to seat normally in the apertures 40, in a generally vertical orientation. Fastening the straps 18 in any appropriate manner then secures the caddy tray 10 to the top step 12 and the ladder 14, while unfastening the straps 18 allows the tray 10 to be stored away when not needed. FIG. 6 illustrates how the tray 10 might appear when secured for use.

While applicant does not wish to be limited to any particular set of dimensions, the following have proven useful in one construction of the invention.

Dimension 100 . . . 13½ inches
Dimension 101 . . . 22 inches
Dimension 102 . . . 7 inches
Dimension 103 . . . 14½ inches
Dimension 104 . . . 12 inches
Dimension 105 . . . 2½ inches
Dimension 106 . . . 6½ inches
Dimension 107 . . . 5 inches
Dimension 108 . . . 2 inches
Dimension 109 . . . 3¾ inches
Dimension 110 . . . ¾ inches
Dimension 111 . . . 1 inch
Dimension 112 . . . 6½ inches
Dimension 113 . . . 7 inches While there has been described what is considered to be a preferred embodiment of the present invention, it will be readily appreciated by those skilled in the art that modifications can be made without departing from the teachings herein of providing a portable ladder top-work station which both organizes tools, parts and components while preventing them from falling from a ladder step to the ground, and which can be easily installed and removed in a manner of seconds, allowing for the temporary holding in a very stabile manner of those types of devices normally utilized by a construction trades worker—who thereby is able to carry on his or her activities without repeatedly climbing up and down a ladder for materials needed, and without having to wear any heavy, bulky tool-type pouch about the waist, even if that were designed to be able to hold materials and parts required to carry out the work activities. For at least such reason, therefore, resort should be had to the claims appended hereto for a true understanding of the scope of the invention.

I claim:

1. The combination comprising:

a step-ladder having a top step of given dimension;

a rigid caddy tray having a top side for receiving individual ones of tools, parts and/or components in prescribed locations, and an underside of defined configuration to hold to said top step when placed thereon; and means cooperating with said tray and said top step for temporarily securing said tray with said top step when in use and for detaching said tray from said top step after use, for subsequent storage without affecting the structural integrity of said ladder;

wherein said means comprising straps which removably straps said tray and said top step when in use;

wherein said straps extends from said tray to encircle under said top step when securing said caddy tray for use;

wherein said caddy tray is of defined configuration providing a snug fit to said top step when placed thereon;

wherein said caddy tray includes a plurality rigid of compartmentalized sections for receiving various ones of tools, parts and/or components;

wherein said caddy tray includes front and rear surfaces, said front surface being of a same dimension as said top step and fits on top of said top step when placed thereon, first and second compartmentalized sections of prescribed depth at respective sides of said said front surface, both said first and second compartmentalized sections extend below said top step of said ladder;

wherein said caddy tray additionally includes a third compartmentalized section defined by said front surface, of a depth less than the depth of said first and second compartmentalized sections;

and wherein said caddy tray further includes a plurality of apertures having various size opening in said rear surface.

2. The combination of claim 1 wherein said straps includes a pair of adjustable straps, each extending from one of said front and rear surfaces of said tray, and under said top step, to fasten to the other of said front and rear surfaces of said tray.

3. The combination of claim 1 wherein both of said first and second compartmentalized sections overlap said top step of said ladder.

4. The combination of claim 3 wherein said rear surface of said caddy tray extends beyond said top step when placed thereon.

5. The combination of claim 4 wherein said caddy tray also includes a block at said rear surface to receive a clamp support thereat.

* * * * *